US006730742B1

(12) United States Patent
Demain

(10) Patent No.: US 6,730,742 B1
(45) Date of Patent: May 4, 2004

(54) POLYPROPYLENE FIBRES

(75) Inventor: Axel Demain, Tourinnes-Saint-Lambert (BE)

(73) Assignee: Atofina Research S.A., Feluy (BE)

( * ) Notice: Subject to any disclaimer, the term of this patent is extended or adjusted under 35 U.S.C. 154(b) by 0 days.

(21) Appl. No.: 10/204,143

(22) PCT Filed: Feb. 19, 2001

(86) PCT No.: PCT/EP01/01935

§ 371 (c)(1),
(2), (4) Date: Oct. 30, 2002

(87) PCT Pub. No.: WO01/61085

PCT Pub. Date: Aug. 23, 2001

(30) Foreign Application Priority Data

Feb. 18, 2000 (EP) ..... 00200553

(51) Int. Cl.[7] ..... C08L 23/00; C08L 23/04; D01F 6/06

(52) U.S. Cl. ..... 525/240

(58) Field of Search ..... 525/240

(56) References Cited

U.S. PATENT DOCUMENTS 6,037,417 A * 3/2000 Nguyen et al. ..... 525/240
6,444,774 B1 * 9/2002 Stahl et al. ..... 526/351
6,646,051 B1 * 11/2003 Demain ..... 525/191

* cited by examiner

*Primary Examiner*—Nathan M. Nutter
(74) *Attorney, Agent, or Firm*—William D. Jackson

(57) ABSTRACT

A polypropylene fiber including greater than 50% by weight of a first isotactic polypropylene produced by a Ziegler-Natta catalyst, from 5 to less than 50% by weight of a second isotactic polypropylene produced by a metallocene catalyst and up to 15% by weight of a syndiotactic polypropylene (sPP).

14 Claims, 3 Drawing Sheets

POLYPROPYLENE FIBRES

Figure 1:
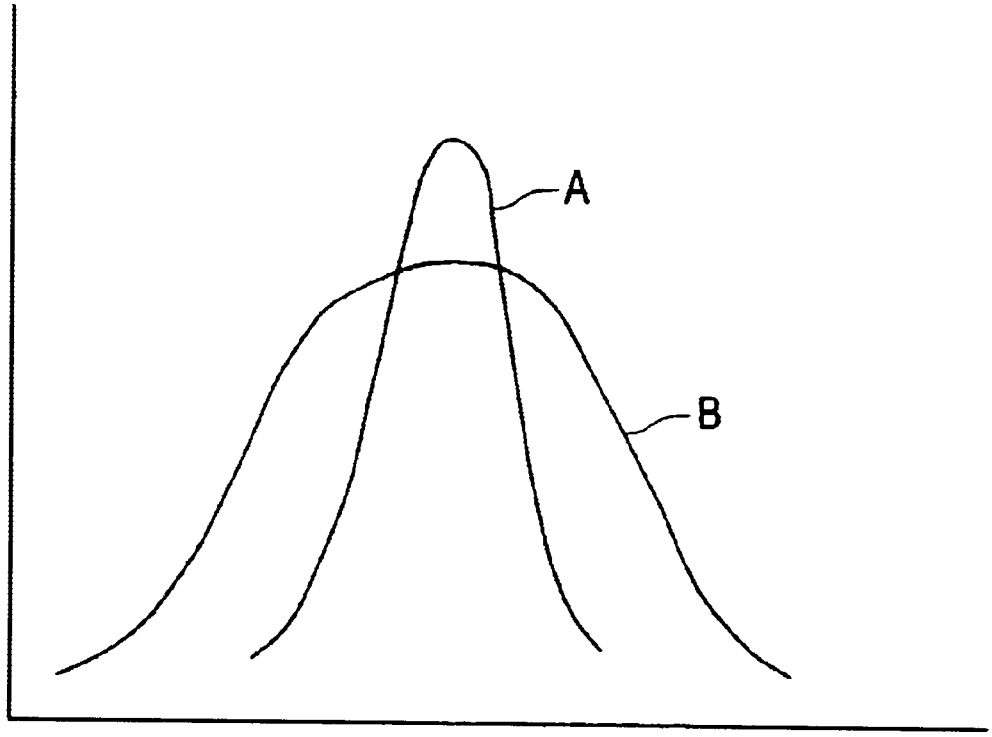

The present invention relates to polypropylene fibres and to fabrics produced from polypropylene fibres.

Polypropylene is well known for the manufacture of fibres, particularly for manufacturing non-woven fabrics.

EP-A-0789096 and its corresponding WO-A-97/29225 discloses such polypropylene fibres which are made of a blend of syndiotactic polypropylene (sPP) and isotactic polypropylene (iPP). That specification discloses that by blending from 0.3 to 3% by weight of sPP, based on the total polypropylene, to form a blend of iPP-sPP, the fibres have increased natural bulk and smoothness, and non-woven fabrics produced from the fibres have an improved softness. Moreover, that specification discloses that such a blend lowers the thermal bonding temperature of the fibres. Thermal bonding is employed to produce the non-woven fabrics from the polypropylene fibres. The specification discloses that the isotactic polypropylene comprises a homopolymer formed by the polymerisation of propylene by Ziegler-Natta catalysis. The isotactic polypropylene typically has a weight average molecular weight Mw of from 100,000 to 4,000,000 and a number average molecular weight Mn of from 40,000 to 100,000, with a melting point of from about 159 to 169° C. However, the polypropylene fibres produced in accordance with this specification suffer from the technical problem that the isotactic polypropylene, being made using a Ziegler-Natta catalyst, does not have particularly high mechanical properties, particularly tenacity.

WO-A-96/23095 discloses a method for providing a non-woven fabric with a wide bonding window in which the non-woven fabric is formed from fibres of a thermoplastic polymer blend including from 0.5 to 25 wt % of syndiotactic polypropylene. The syndiotactic polypropylene may be blended with a variety of different polymers, including isotactic polypropylene. The specification includes a number of examples in which various mixtures of syndiotactic polypropylene with isotactic polypropylene were produced. The isotactic polypropylene comprised commercially available isotactic polypropylene, which is produced using a Ziegler-Natta catalyst. It is disclosed in the specification that the use of syndiotactic polypropylene widens the window of temperature over which thermal bonding can occur, and lowers the acceptable bonding temperature.

WO-A-96/23095 also discloses the production of fibres from blends including syndiotactic polypropylene which are either bi-component fibres or bi-constituent fibres. Bi-component fibres are fibres which have been produced from at least two polymers extruded from separate extruders and spun together to form one fibre. Bi-constituent fibres are produced from at least two polymers extruded from the same extruder as a blend. Both bi-component and bi-constituent fibres are disclosed as being used to improve the thermal bonding of Ziegler-Natta polypropylene in non-woven fabrics. In particular, a polymer with a lower melting point compared to the Ziegler-Natta isotactic polypropylene, for example polyethylene, random copolymers or terpolymers, is used as the outer part of the bi-component fibre or blended in the Ziegler-Natta polypropylene to form the bi-constituent fibre.

EP-A-0634505 discloses improved propylene polymer yarn and articles made therefrom in which for providing yarn capable of increased shrinkage syndiotactic polypropylene is blended with isotactic polypropylene with there being from 5 to 50 parts per weight of syndiotactic polypropylene. It is disclosed that the yarn has increased resiliency and shrinkage, particularly useful in pile fabric and carpeting. It is disclosed that the polypropylene blends display a lowering of the heat softening temperature and a broadening of the thermal response curve as measured by differential scanning calorimetry as a consequence of the presence of syndiotactic polypropylene.

U.S. Pat. No. 5,269,807 discloses a suture fabricated from syndiotactic polypropylene exhibiting a greater flexibility than a comparable suture manufactured from isotactic polypropylene. The syndiotactic polypropylene may be blended with, inter alia, isotactic polypropylene.

EP-A-0451743 discloses a method for moulding syndiotactic polypropylene in which the syndiotactic polypropylene may be blended with a small amount of a polypropylene having a substantially isotactic structure. It is disclosed that fibres may be formed from the polypropylene. It is also disclosed that the isotactic polypropylene is manufactured by the use of a catalyst comprising titanium trichloride and an organoaluminium compound, or titanium trichloride or titanium tetrachloride supported on magnesium halide and an organoaluminium compound, i.e. a Ziegler-Natta catalyst.

EP-A-0414047 discloses polypropylene fibres formed of blends of syndiotactic and isotactic polypropylene. The blend includes at least 50 parts by weight of the syndiotactic polypropylene and at most 50 parts by weight of the isotactic polypropylene. It is disclosed that the extrudability of the fibres is improved and the fibre stretching conditions are broadened.

It is further known to produce syndiotactic polypropylene using metallocene catalysts as has been disclosed for example in U.S. Pat. No. 4,892,851.

Recently, metallocene catalysts have also been employed to produce isotactic polypropylene. Isotactic polypropylene which has been produced using a metallocene catalyst is identified hereinafter as miPP. Fibres made of miPP exhibit much higher mechanical properties, mainly tenacity, than typical Ziegler-Natta polypropylene based fibres, hereinafter referred to as ZNPP fibres. However, this gain in tenacity is only partly transferred to non-woven fabrics which have been produced from the miPP fibres by thermal bonding. Indeed, fibres produced using miPP have a very narrow thermal bonding window, the window defining a range of thermal bonding temperatures through which, after thermal bonding of the fibres, the non-woven fabric exhibits the best mechanical properties. As a result, only a small number of the miPP fibres contribute to the mechanical properties of the non-woven fabric. Also, the quality of the thermal bond between adjacent miPP fibres is poor. Thus known miPP fibres have been found to be more difficult to thermally bond than ZNPP fibres, despite a lower melting point.

WO-A-97/10300 discloses polypropylene blend compositions wherein the blend may comprise from 25% to 75% by weight metallocene isotactic polypropylene and from 75 to 25% by weight Ziegler-Natta isotactic polypropylene copolymer. The specification is fundamentally directed to the production of films from such polypropylene blends.

U.S. Pat. No. 5,483,002 discloses propylene polymers having low-temperature impact strength containing a blend of one semi-crystalline propylene homopolymer with either a second semi-crystalline propylene homopolymer or a non-crystallising propylene homopolymer.

EP-A-0538749 discloses a propylene copolymer composition for production of films. The composition comprises a blend of two components, the first component comprising either a propylene homopolymer or a copolymer of propylene with ethylene or another alpha-olefin having a carbon number of 4 to 20 and the second component comprising a copolymer of propylene with ethylene and/or an alpha-olefin having a carbon number of 4 to 20.

It is known in the art to blend into a polypropylene produced using a Ziegler-Natta catalyst a second component comprising a random polypropylene, typically in an amount of around 20 to 50 wt % of the blend. Such a blend has been found to provide good thermal bonding when fibres produced from the blend are thermally bonded to form a non-woven fabric. The good thermal bonding results from a temperature overlap of the melting points of the Ziegler-Natta polypropylene and the random polypropylene. The thermal bonding is also achieved as a result of both the Ziegler-Natta polypropylene and the random polypropylene having relatively broad molecular weight distributions which provides a good blend and thus tends to enhance the thermal bondability of fibres.

It is an aim of the present invention to broaden the thermal bonding window of ZNPP fibres. It is a further aim of the invention to provide non-woven fabrics of ZNPP fibres exhibiting improved mechanical properties, in particular tenacity.

It is known that polypropylene fibres, and non-woven fabrics made of polypropylene fibres, tend to feel rough to the touch. It is also an aim of the present invention to improve the softness of polypropylene fibres.

The present invention provides a polypropylene fibre including greater than 50% by weight of a first isotactic polypropylene produced by a Ziegler-Natta catalyst, from 5 to less than 50% by weight of a second isotactic polypropylene produced by a metallocene catalyst and up to 15% by weight of a syndiotactic polypropylene (sPP).

The polymeric fibre may preferably include from 60 to 80% by weight of the first isotactic polypropylene and from 10 to less than 50%, more preferably from 20 to 40% by weight of the second isotactic polypropylene.

Preferably, up to lot by weight of the syndiotactic polypropylene (sPP) is included in the polypropylene fibre. The addition of sPP improves the softness of the fibres.

The first polypropylene produced by the Ziegler-Natta catalyst (ZNPP) may be a homopolymer, copolymer or terpolymer.

The second polypropylene produced by the metallocene catalyst (miPP) is a homopolymer, copolymer, being either a random or block copolymer, or terpolymer of isotactic polypropylene produced by a metallocene catalyst.

Preferably, the second polypropylene has a dispersion index (D) of from 1.8 to 8. Preferably, the second polypropylene has a melting temperature in the range of from 130 to 161° C. for homopolymer and a melting temperature of from 80 to 160° C. for a copolymer or terpolymer.

The miPP preferably has a melt flow index (MFI) of from 1 to 2500 g/10 mins. In this specification the MFI values are those determined using the procedure of ISO 1133 using a load of 2.16 kg at a temperature of 230° C.

More preferably, the second polypropylene homopolymer or copolymer has an Mn of from 30,000 to 130,000 kDa and the MFI may range from 1 to 2000 g/10 min and preferably from 5 to 90 g/10 min for spunlaid or for staple fibres.

Preferably, the first polypropylene has a dispersion index (D) of from 3 to 12. Preferably, the first polypropylene has a melting temperature in the range of from 80 to 169° C., more preferably a melting temperature of from 159 to 169° C. for homopolymer and a melting temperature of from 80to 168° C. for a copolymer or terpolymer. A typical melting temperature for ZNPP is 162° C.

The ZNPP preferably has a melt flow index (MFI) of from 1 to 100 g/10 mins.

More preferably, the first polypropylene homopolymer has a MFI ranging from 15 to 60 g/10 min for spunlaid or 10 to 30 g/10 min for staple fibres The sPP is preferably a homopolymer or a random copolymer with a RRRR of at least 70%. The sPP may alternatively be a block copolymer having a higher comonomer content, or a terpolymer. If the comonomer content is above 1.5 wt %, the sPP tends to become sticky, thus resulting in problems when spinning the fibres or thermally bonding the fibres. Preferably, the sPP has a melting temperature of up to about 130° C. The sPP typically has two melting peaks, one being around 112° C. and the other being around 128° C. The sPP typically has an MFI of from 0.1 to 1000 g/10 min, more typically from 1 to 60 g/10 min. The sPP may have a monomodal or multimodal molecular weight distribution, and most preferably is a bimodal polymer in order to improve the processability of the sPP.

The present invention further provides a fabric produced from the polypropylene fibre of the invention.

The present invention yet further provides a product including that fabric, the product being selected from among others a filter, personal wipe, diaper, feminine hygiene product, incontinence product, wound dressing, bandage, surgical gown, surgical drape and protective cover.

The present invention is predicated on the discovery by the present inventor that when blended with a major amount of ZNPP, miPP causes improved thermal bonding of the ZNPP, without a significant modification of the mechanical properties of the fibres themselves. The present inventor has discovered surprisingly that by blending less than 50% by weight miPP into the Ziegler-Natta polypropylene, this provides enhanced thermal bonding of the Ziegler-Natta polypropylene despite the miPP having a narrower molecular weight distribution than that of the ZNPP, and also the random PP employed in the prior art referred to hereinabove, which would have been considered by the person skilled in the art to have reduced the thermal bonding effect.

Indeed, narrowing molecular weight distribution is known to reduce the bonding window temperature of the fibre. Thus the present inventor has discovered surprisingly that by blending of miPP into ZNPP, with the miPP having a typical melting range of from about 130° C. to about 161° C., which is lower than the typical melting range of ZNPP of from about 159° C. to about 169° C., the improvement in thermal bonding is achieved as a result of this lower melting point of the miPP, despite the narrower molecular weight distribution of the miPP which would suggest poorer thermal bonding. As a consequence, at any given thermal bonding temperature, more fibres are thermally bonded compared to pure Zn PP fibres and the bonding strength improves, thereby improving the mechanical properties of the non-woven fabric produced thereby.

Figure 2:
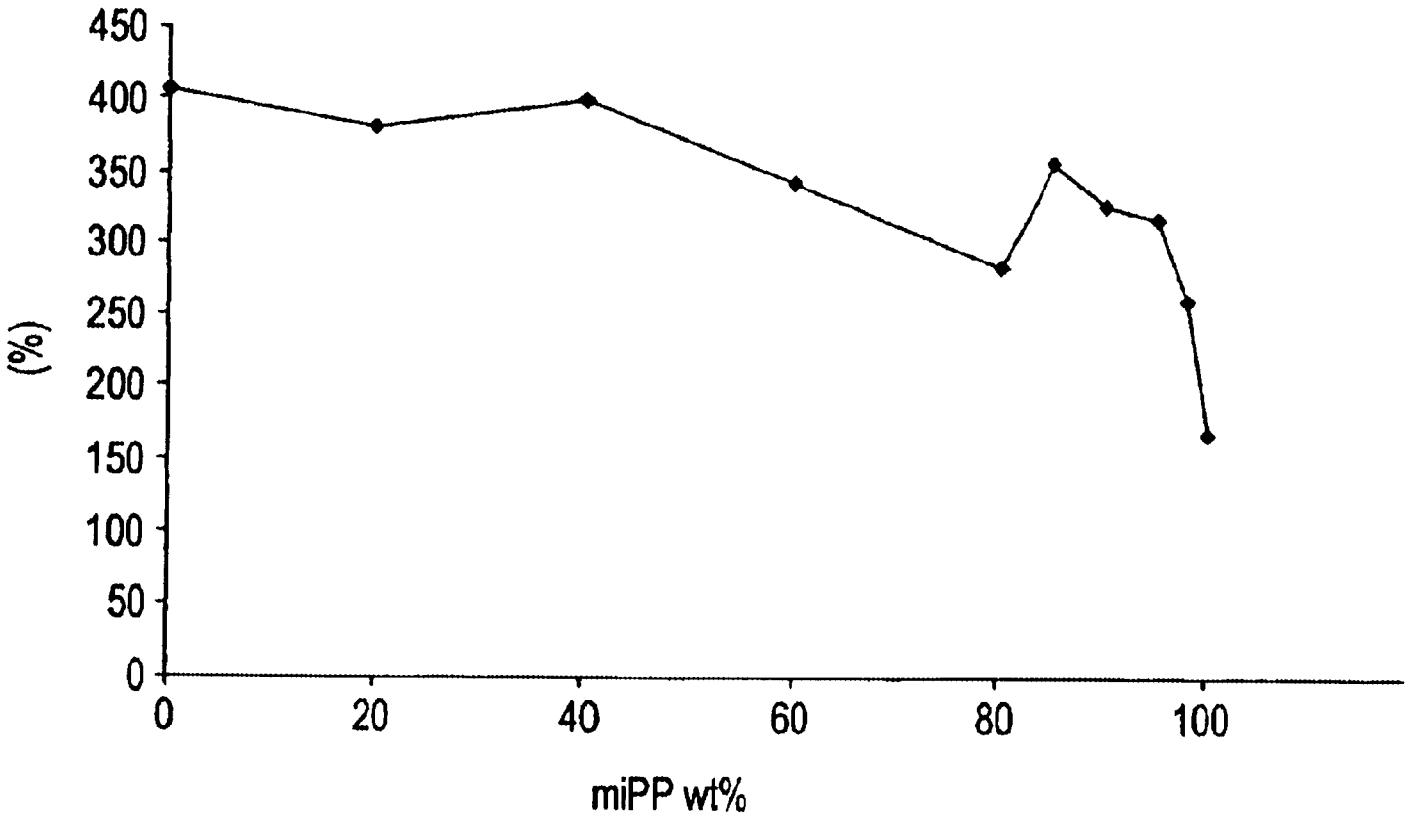
Figure 3:
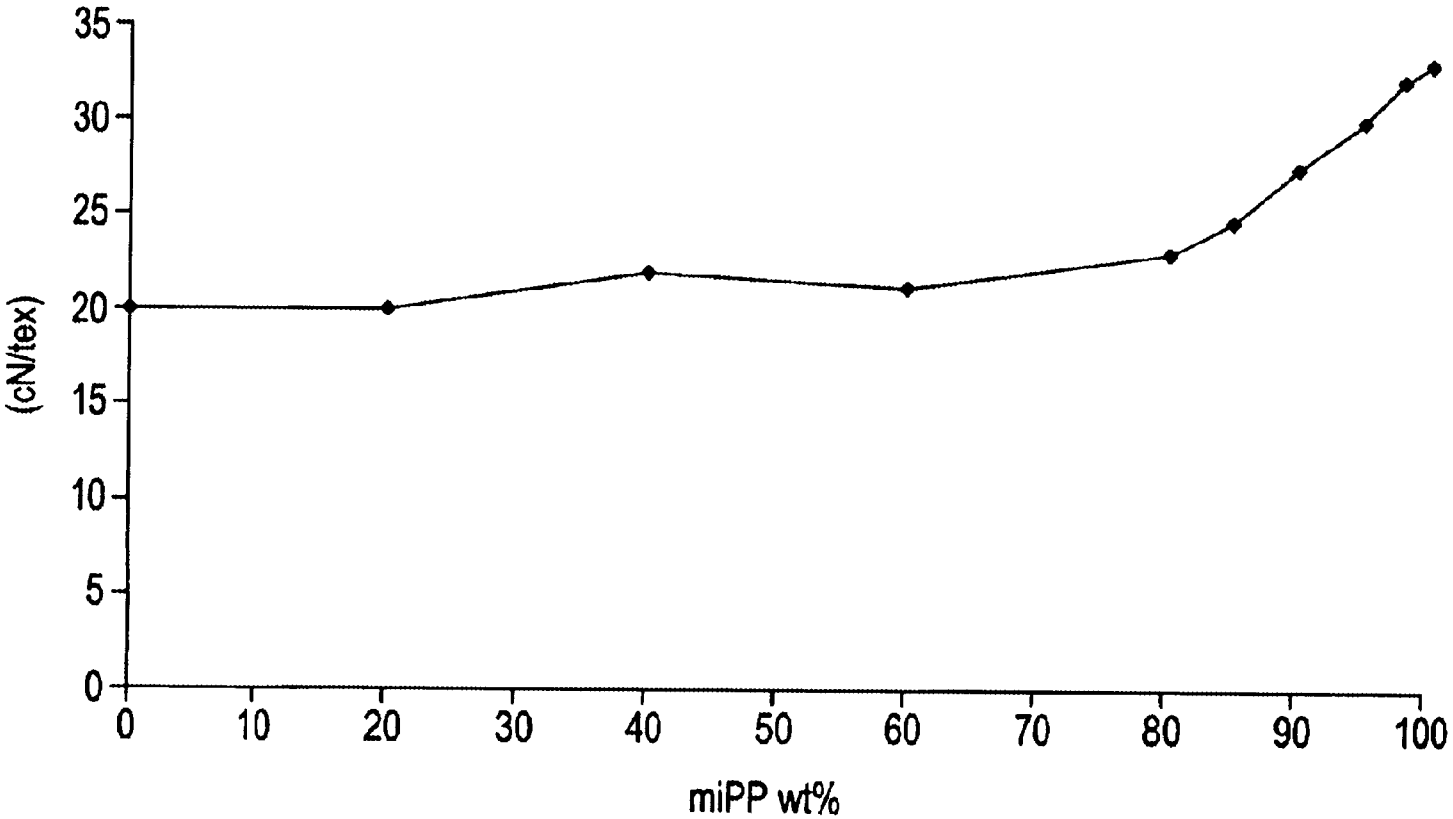

The present invention will now be described by way of example only with reference to the accompanying drawings, in which:

FIG. 1 is a graph showing the molecular weight distributions for a typical ZNPP and a typical random PP and for a typical miPP and FIGS. 2 and 3 are graphs showing the relationship between, respectively, elongation (%) at maximum drawing force and fibre tenacity (cN/tex) at maximum drawing force with respect to miPP amount for fibres produced from blends of miPP and znPP.

Referring to FIG. 1, there is shown the common molecular weight distribution for a typical ZNPP and a typical random PP (line B), and also the molecular distribution for a typical miPP (line A). It may be seen that for both the ZNPP and the random PP, these both exhibit a broad molecular weight distribution compared to miPP which show that the ZNPP and the random PP may readily be blended together. In contrast, the miPP has a much narrower molecular weight distribution which would have been considered, when blended into a ZNPP, to have reduced the thermal bonding. In contrast, the present inventor has found that despite the narrow molecular weight distribution of the miPP, nevertheless when the miPP is blended in an amount of from 10 to 50% by weight into the ZNPP, the thermal bonding of the ZNPP is improved without significant modification of the mechanical properties of the blend.

An industrial thermal bonding process for producing a non-woven fabric employs the passage at high speed of a layer of fibres to be thermally bonded through a pair of heated rollers. This process thus requires rapid and uniform melting of the surfaces of adjacent fibres in order for a strong and reliable thermal bond to be achieved. The addition of miPP to the ZNPP tends to lower the thermal bonding temperature of the fibres so as to broaden the thermal bonding temperature range or "window" for the fibres, thereby to increase the ease of thermal bonding the fibres together. Thus the incorporation of miPP into ZNPP enables the maximum strength of the non-woven fabric to be greatly increased as a result of this increased thermal bond formation between adjacent fibres.

The miPP employed in accordance with the invention has a narrow molecular weight distribution, typically having a dispersion index D of from 1.8 to 4, more preferably from 1.8 to 3. The dispersion index D is the ratio Mw/Mn, where Mw is the weight number average molecular weight and Mn is the number average molecular weight of the polymer. The miPP has a melting temperature in the range of from 140° C. to 155° C. The properties of two typical miPP resins for use in the invention are specified in Table 1.

The addition of up to 15% wt (optionally up to 10 wt %) sPP to the miPP also has been found by the inventor to improve the softness of the fibres. As a result of the phenomenon of the rejection of small amounts of sPP to the surface of the fibres, the inventor has found that the softness of the fibres may be increased using only small amounts of sPP, for example from 0.3 wt % sPP in the sPP/miPP/ZNPP blend. Since the blending of sPP into miPP and ZNPP permits a lower thermal bonding temperature to be employed than would be employed for pure miPP fibres, and since lower thermal bonding temperatures tend to reduce the roughness to the touch of a non-woven fabric produced from the fibres, introducing sPP in accordance with the invention into miPP and ZNPP improves the softness of the non-woven fabric. The composition of a typical sPP for use in the invention is specified in Table 1.

Furthermore, when sPP is incorporated into miPP and ZNPP to form blends thereof, and when those blends are used to produce spun fibres, the sPP promotes fibres having improved natural bulk, resulting in improved softness of the non-woven fabric.

In addition, the use of miPP in blends with ZNPP and optionally sPP in accordance with the invention tends to provide fibres which can be more readily spun as compared to known ZNPP fibres. The substantial reduction of such long chains in the molecular weight distribution of the miPP tends to reduce built-in stress during spinning thereby to allow in an increase in the maximum spin speed for the fibres of the miPP/ZNPP blends in accordance with the invention.

The incorporation of sPP into miPP and ZNPP to form blends thereof provides a broader thermal bonding window. The thermal bonding temperature of fibres produced from such blends is also Slightly lower. The fibres and non-woven fabrics produced from the blends have increased softness and the spun fibres have natural bulk as a result of the introduction of sPP into the miPP and ZNPP. The fibres also have improved resiliency compared to known polypropylene ZNPP fibres as a result of the use of sPP. Furthermore, the use of miPP allows the production of finer fibres, resulting in softer fibres and a more homogeneous distribution of the fibres in the non-woven fabric.

Although it was known prior to the present invention to use a second polymer in fibres, it has not heretofore been proposed to employ miPP in a blend with ZNPP for the production of fibres. Efficient thermal bonding of the fibres is required to transfer the outstanding mechanical properties of the fibres into non-woven fabrics. The spinnability of the fibres produced using miPP/ZNPP blends in accordance with the invention is not significantly modified as compared to known fibres.

The fibres produced in accordance with the invention may be either bi-component fibres or bi-constituent fibres. For bi-component fibres, miPP and ZNPP are fed into two different extruders. Thereafter the two extrudates are spun together to form single fibres. For the bi-constituent fibres, blends of miPP/ZNPP are obtained by: dry blending pellets, flakes or fluff of the two polymers before feeding them into a common extruder; or using pellets or flakes of a blend of miPP and ZNPP which have been extruded together and then re-extruding the blend from a second extruder.

When the blends of ZNPP/miPP are used to produce fibres in accordance with the invention, it is possible to adapt the temperature profile of the spinning process to optimise the processing temperature yet retaining the same throughput as with pure miPP. For the production of spunlaid fibres, a typical extrusion temperature would be in the range of from 200° C. to 260° C., most typically from 230° C. to 250° C. For the production of staple fibres, a typical extrusion temperature would be in the range of from 230° C. to 330° C., most typically from 270° C. to 310° C.

The fibres produced in accordance with the invention may be produced from ZNPP/miPP blends having other additives to improve the mechanical processing or spinnability of the fibres. The fibres produced in accordance with the invention may be used to produce non-woven fabrics for use in filtration; in personal care products such as wipers, diapers, feminine hygiene products and incontinence products; in medical products such as wound dressings, surgical gowns, bandages and surgical drapes; in protective covers; in outdoor fabrics and in geotextiles. Non-woven fabrics made with the ZNPP/miPP fibres of the invention can be part of such products, or constitute entirely the products. As well as making non-woven fabrics, the fibres may also be employed to make a knitted fabric or a mat. The non-woven fabrics produced from the fibres in accordance with the invention can be produced by several processes, such as air through blowing, melt blowing, spun bonding or bonded carded processes. The fibres of the invention may also be formed as a non-woven spunlace product which is formed without thermal bonding by fibres being entangled together to form a fabric by the application of a high pressure-fluid such as air or water.

The present invention will now be described in greater detail by reference to the following non-limiting examples.

EXAMPLES 1

In accordance with this example, the properties of a non-woven product composed of polypropylene fibres incorporating up to 50 wt % miPP with the remainder being znPP were compared to fibres composed of pure miPP. Thus the pure miPP had an MFI of 32 g/10 mins and a Mw/Mn ratio of 3. The znPP had an MFI of 12 g/10 mins and an Mw/Mn ratio of 7. A blend, hereinafter called Poly 1, of the miPP and the znPP with a weight ratio of 33 wt % miPP/67 wt % znPP was produced. Fibres were made both of the blend Poly 1 and of the pure miPP. The fibres were spun by a long spin process, with the polymer temperature in the spinnerets being 280° C. The fibre titre after spinning was 2.3 dtex and the fibre titre after drawing was 2.1 dtex. The fibres were texturised and cut after the drawing step. They were then stored in bales of 400 kg for 10 days. The fibres were then subjected to carding and bonding at a speed of 110 m/minute. Thereafter, non-woven products having a weight of 20 g/m$^2$ were produced by thermal bonding. The thermal bonding temperature and the mechanical properties of the non-wovens thereby produced both for the Poly 1 and the pure miPP are shown in Table 2.

It may be seen from Table 2 that the mechanical properties of the non-woven thermally bonded product of Poly 1 are greater than that for pure miPP at corresponding thermal bonding temperatures.

EXAMPLE 2

In accordance with this example, various blends of znPP and miPP were made and the compositions of the blends are specified in Table 3.

The miPP had an MFI of 13 g/10 min. The znPP was the same as that employed in Example 1. The blends were prepared by dry blending pellets of the components and pouring the dry blend into the feeder of the extruder immediately after blending. Fibres were then produced from the extruded blend. The fibre was produced using a spinneret having 224 holes with a length/diameter ratio of 8/0.8. The extrusion temperature was 285° C. with quenching air at 15° C. at a pressure of 50 Pa. The temperature of the drawing godets was 80° C. For each blend, fibres were produced under the conditions of take-up at 1600 m/min followed by drawing with a draw ratio (SR) of 1.3. The throughput per hole was adjusted to keep the fibre titre at around 2.5 dtex.

Table 3 shows the titre, the fibre tenacity at 10% elongation, the elongation at maximum drawing force, the fibre tenacity at maximum drawing force (sigma@max). FIGS. 2 and 3 are graphs showing the relationship between the elongation at maximum drawing force and the fibre tenacity at maximum drawing force, respectively, with respect to the amount of miPP in the blend.

Table 4 shows the titre, the fibre tenacity at 10% elongation, the elongation at maximum drawing force, the fibre tenacity at maximum drawing force (sigma@max) for fibres produced as described here above but without drawing.

It may be noted that for a blend having up to 50 wt % miPP in the blend of znPP/miPP, the elongation at maximum drawing force and the fibre tenacity at maximum drawing force are substantially constant with respect to the miPP amount. Thus by adding miPP to a znPP/miPP blend up to amount of 50 wt % miPP, the mechanical characteristics of the fibre are not substantially modified, in particular the fibre elongation and tenacity, but, as shown in Example 1, the characteristics of the bonding of the fibres to form thermally bonded non-wovens are improved.

EXAMPLE 3

This example demonstrates the increase in bulk or softness of polypropylene fibres by incorporating into the blend of znPP/miPP an amount of sPP.

When polypropylene fibres are laid on a flat surface, such as a glass plate, the morphology of the fibre, in particular its degree of straightness or, conversely, its degree of waviness, is an indication of the bulk of the fibre. The fibre, which can be examined by optical microscopy, can be seen to have a wavy or substantially sinusoidal morphology, with increased waviness (i.e. a reduced pitch between peaks of adjacent waves) corresponding to increased bulk or softness of the fibre.

When sPP was added to a polypropylene homopolymer in an amount up to 15 wt %, it has been found that the distance between two peaks of the wavy surface decreases, in turn meaning that the bulk or softness of the fibres increases. For example when 5 wt % sPP was blended into a Ziegler-Natta polypropylene homopolymer, the distance between the peaks was 5.1 mm whereas when 15 wt % sPP was blended into the same polypropylene, the distance between the peaks was around 4 mm. This demonstrates that the bulk or softness of the fibres was increased with increasing amount of sPP in the base polypropylene.

TABLE 1

| | | ZNPP | sPP | miPP1 | miPP2 |
|---|---|---|---|---|---|
| $MI_2$ | | 14 | 3.6 | 32 | 13 |
| Tm | ° C. | 162 | 110 and 127 | 148.7 | 151 |
| Mn | kDa | 41983 | 37426 | 54776 | 85947 |
| Mw | kDa | 259895 | 160229 | 137423 | 179524 |
| Mz | kDa | 1173716 | 460875 | 242959 | 321119 |
| Mp | kDa | 107648 | 50516 | 118926 | 150440 |
| D | | 6.1 | 4.3 | 2.5 | 2.1 |

TABLE 2

| Blend | Thermal Bonding Temperature (° C.) | Max Force Mach. Dir (N/5 cm) | Elong @ break Mach. dir (%) | Max Force Trans dir (N/5 cm) | Elong @ break Trans dir (%) |
|---|---|---|---|---|---|
| Poly 1 | 142 | 27 | 85 | 12 | 95 |
| Poly 1 | 148 | 35 | 60 | 14 | 65 |
| Pure miPP | 142 | 13 | 25 | 6 | 20 |
| Pure miPP | 148 | 12 | 20 | 6 | 20 |

TABLE 3

| | | Take-up: 1600 m/min followed by drawing (SR = 1.3) | | | |
|---|---|---|---|---|---|
| wt % znPP | wt % miPP | Titre (dtex) | Tenacity @ 10% (cN/tex) | Elong @ max (%) | Sigma @ max (cN/tex) |
| 100 | 0 | 2.6 | 9.6 | 407 | 20.0 |
| 80 | 20 | 2.6 | 9.2 | 379 | 19.8 |
| 60 | 40 | 2.6 | 9.2 | 397 | 21.5 |
| 40 | 60 | 2.6 | 8.9 | 339 | 20.7 |
| 20 | 80 | 2.6 | 8.8 | 281 | 22.3 |
| 15 | 85 | 2.5 | 7.8 | 352 | 23.9 |
| 10 | 90 | 2.5 | 8.2 | 322 | 26.7 |
| 5 | 95 | 2.5 | 8.6 | 312 | 29.3 |
| 2 | 98 | 2.5 | 9.2 | 256 | 31.4 |
| 0 | 100 | 2.6 | 11.5 | 164 | 32.3 |

TABLE 4

| | | Direct Take-up: 1600 m/min | | | |
|---|---|---|---|---|---|
| wt % znPP | wt % miPP | Titre (dtex) | Tenacity @ 10% (cN/tex) | Elong @ max (%) | Sigma @ max (cN/tex) |
| 100 | 0 | 2.6 | 6.8 | 435 | 14.8 |
| 80 | 20 | 2.6 | 6.5 | 513 | 15.9 |
| 60 | 40 | 2.5 | 6.6 | 456 | 16.4 |
| 40 | 60 | 2.6 | 6.3 | 461 | 17.1 |
| 20 | 80 | 2.6 | 6.1 | 443 | 20.3 |
| 15 | 85 | 2.2 | 5.8 | 485 | 18.9 |
| 10 | 90 | 2.4 | 5.8 | 424 | 20.4 |
| 5 | 95 | 2.6 | 5.4 | 496 | 20.5 |
| 2 | 98 | 2.6 | 5.5 | 363 | 24.0 |
| 0 | 100 | 2.6 | 6.2 | 285 | 27.9 |

What is claimed is:

1. A polypropylene fibre including greater than 50% by weight of a first isotactic polypropylene produced by a Ziegler-Natta catalyst, from 5 to less than 50% by weight of a second isotactic polypropylene produced by a metallocene catalyst and up to 15% by weight of a syndiotactic polypropylene (sPP).

2. A polypropylene fibre according to claim 1 including from 10 to less than 50% by weight of the second isotactic polypropylene.

3. A polypropylene fibre according to claim 2 including from 60 to 80% by weight of the first isotactic polypropylene and from 20 to 40% by weight of the second isotactic polypropylene.

4. A polypropylene fibre according to claim 1 wherein the second polypropylene is a homopolymer, copolymer or terpolymer of isotactic polypropylene or a blend of such polymers.

5. A polypropylene fibre according to claim 4 wherein the second polypropylene has a dispersion index (D) of from 1.8 to 8.

6. A polypropylene fibre according to claim 4 wherein the second polypropylene has a melting temperature in the range of from 80 to 161° C.

7. A polypropylene fibre according to claim 1 wherein the second polypropylene has a melt flow index (MFI) of from 1 to 2500 g/10 mins.

8. A polypropylene fibre according to claim 7 wherein the first polypropylene has a dispersion index of from 3 to 12.

9. A polypropylene fibre according to claim 1 wherein the first polypropylene homopolymer has a melting temperature in the range of from 159 to 169° C.

10. A polypropylene fibre according to claim 1 wherein the amount of syndiotactic polypropylene (sPP) is up to 10% by weight.

11. A polypropylene fibre according to claim 1 wherein the sPP is a homopolymer, a random copolymer, a block copolymer or a terpolymer or a blend of such polymers.

12. A polypropylene fibre according to claim 1 wherein the sPP has a melting temperature of up to about 130° C.

13. A fabric produced from the polypropylene fibre according to claim 1.

14. A product including a fabric according to claim 1, the product being selected from a filter, personal wipe, diaper, feminine hygiene product, incontinence product, wound dressing, bandage, surgical gown, surgical drape, protective cover, geotextiles and outdoor fabrics.

* * * * *

UNITED STATES PATENT AND TRADEMARK OFFICE

CERTIFICATE OF CORRECTION

PATENT NO. : 6,730,742 B1
DATED : May 4, 2004
INVENTOR(S) : Axel Demain

It is certified that error appears in the above-identified patent and that said Letters Patent is hereby corrected as shown below:

Column 3,
Line 35, replace "lot" with -- 10% --.

Signed and Sealed this

Thirtieth Day of November, 2004

JON W. DUDAS
*Director of the United States Patent and Trademark Office*